US009568873B2

(12) United States Patent
Horishita et al.

(10) Patent No.: US 9,568,873 B2
(45) Date of Patent: Feb. 14, 2017

(54) IMAGE FORMING APPARATUS WITH DETECTION UNIT, CONTROL METHOD OF IMAGE FORMING APPARATUS SHIFTING BETWEEN POWER STATES, AND STORAGE MEDIUM

(71) Applicant: CANON KABUSHIKI KAISHA, Tokyo (JP)

(72) Inventors: Yusuke Horishita, Yokohama (JP); Yuichi Hagiwara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/644,026

(22) Filed: Mar. 10, 2015

(65) Prior Publication Data

US 2015/0261159 A1 Sep. 17, 2015

(30) Foreign Application Priority Data

Mar. 14, 2014 (JP) ..... 2014-051810

(51) Int. Cl.
*G03G 15/00* (2006.01)

(52) U.S. Cl.
CPC ..... *G03G 15/5004* (2013.01)

(58) Field of Classification Search
CPC ..... G03G 15/5004; G03G 15/5016
USPC ..... 399/88
See application file for complete search history.

(56) References Cited

U.S. PATENT DOCUMENTS

| | | | | |
|---|---|---|---|---|
| 2010/0150600 | A1* | 6/2010 | Oyoshi | 399/88 |
| 2012/0296602 | A1* | 11/2012 | Oyoshi | 702/150 |
| 2012/0326038 | A1* | 12/2012 | Yamashina et al. | 250/338.3 |
| 2012/0327458 | A1* | 12/2012 | Baba et al. | 358/1.15 |
| 2012/0328319 | A1* | 12/2012 | Ogata et al. | 399/75 |
| 2013/0010335 | A1* | 1/2013 | Baba et al. | 358/3.01 |
| 2013/0057894 | A1* | 3/2013 | Narushima et al. | 358/1.14 |
| 2013/0120779 | A1* | 5/2013 | Baba et al. | 358/1.13 |
| 2013/0250372 | A1* | 9/2013 | Ogata et al. | 358/442 |
| 2014/0029037 | A1* | 1/2014 | Oyoshi | 358/1.13 |
| 2014/0140716 | A1* | 5/2014 | Ogata et al. | 399/81 |

FOREIGN PATENT DOCUMENTS

JP 2002-71833 A 3/2002

* cited by examiner

*Primary Examiner* — Arlene Heredia Ocasio
(74) *Attorney, Agent, or Firm* — Canon U.S.A., Inc. IP Division

(57) ABSTRACT

An image forming apparatus that shifts between a first power state and a second power state where power consumption is less than in the first power state. The image forming apparatus includes a detecting unit that includes a plurality of elements arranged on a line or in a grid to detect heat emitted from an object and a determination unit that determines whether to shift the image forming apparatus from the second power state to the first power state based on a detection result of the detecting unit and that controls the shift.

13 Claims, 11 Drawing Sheets

ENTERING DETECTION AREA

REACHING RETURN-FROM-POWER-SAVING DISTANCE

APPARATUS BECOMING USABLE
10
DETECTION AREA
HUMAN BODY
DETECTION RESULT OF HUMAN PRESENCE SENSOR
a b c d e f g h
8 7 6 5 4 3 2 1
HIGH TEMPERATURE (29°C)
LOW TEMPERATURE (26°C)

FIRST FRAME
WHEN USING APPARATUS FROM FRONT
HUMAN BODY
10
6010
DETECTION AREA
6013
6015
6011
6012
a b c d e f g h

SECOND FRAME
HUMAN BODY

THIRD FRAME
HIGH TEMPERATURE (29°C)
LOW TEMPERATURE (26°C)

FIRST FRAME
WHEN PASSING BY APPARATUS FROM FRONT

SECOND FRAME

THIRD FRAME

SENSOR THRESHOLD WHEN DETECTION STARTS IN AREA A

SENSOR THRESHOLD WHEN DETECTION STARTS IN AREA B

SENSOR THRESHOLD WHEN DETECTION STARTS IN AREA C

ENTERING DETECTION AREA

IN FRONT OF APPARATUS

LEAVING APPARATUS
6010
10
HUMAN BODY
DETECTION AREA
DETECTION RESULT OF HUMAN PRESENCE SENSOR
HIGH TEMPERATURE (29°C)
LOW TEMPERATURE (26°C)
a b c d e f g h
8 7 6 5 4 3 2 1

ENTERING DETECTION AREA
NON-DETECTION AREA
DETECTION AREA
10
6010
6014
6015
6011
6012
6013
DETECTION RESULT OF HUMAN PRESENCE SENSOR

TAKING DISCHARGED SHEET

LEAVING APPARATUS
HIGH TEMPERATURE (29°C)
LOW TEMPERATURE (26°C)
a b c d e f g h
1 2 3 4 5 6 7 8

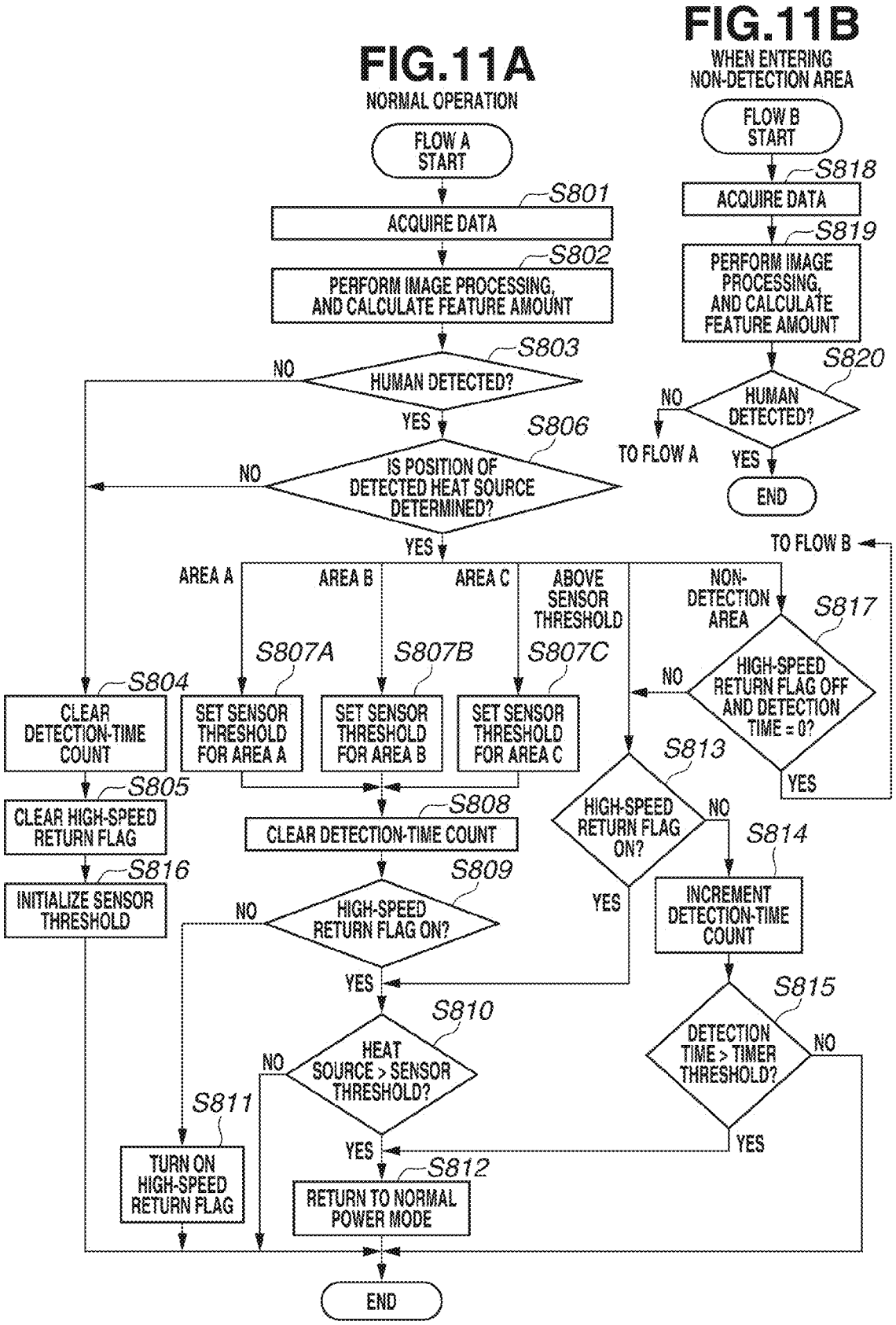
FIG.11A
NORMAL OPERATION
FLOW A START
S801
ACQUIRE DATA
S802
PERFORM IMAGE PROCESSING, AND CALCULATE FEATURE AMOUNT
S803
HUMAN DETECTED?
NO
YES
S806
IS POSITION OF DETECTED HEAT SOURCE DETERMINED?
NO
YES
AREA A
AREA B
AREA C
ABOVE SENSOR THRESHOLD
NON-DETECTION AREA
S804
CLEAR DETECTION-TIME COUNT
S807A
SET SENSOR THRESHOLD FOR AREA A
S807B
SET SENSOR THRESHOLD FOR AREA B
S807C
SET SENSOR THRESHOLD FOR AREA C
S805
CLEAR HIGH-SPEED RETURN FLAG
S816
INITIALIZE SENSOR THRESHOLD
S808
CLEAR DETECTION-TIME COUNT
S809
HIGH-SPEED RETURN FLAG ON?
NO
YES
S810
HEAT SOURCE > SENSOR THRESHOLD?
NO
YES
S811
TURN ON HIGH-SPEED RETURN FLAG
S812
RETURN TO NORMAL POWER MODE
END
FIG.11B
WHEN ENTERING NON-DETECTION AREA
FLOW B START
S818
ACQUIRE DATA
S819
PERFORM IMAGE PROCESSING, AND CALCULATE FEATURE AMOUNT
S820
HUMAN DETECTED?
NO
TO FLOW A
YES
END
TO FLOW B
S817
HIGH-SPEED RETURN FLAG OFF AND DETECTION TIME = 0?
NO
YES
S813
HIGH-SPEED RETURN FLAG ON?
NO
YES
S814
INCREMENT DETECTION-TIME COUNT
S815
DETECTION TIME > TIMER THRESHOLD?
NO
YES

IMAGE FORMING APPARATUS WITH DETECTION UNIT, CONTROL METHOD OF IMAGE FORMING APPARATUS SHIFTING BETWEEN POWER STATES, AND STORAGE MEDIUM

BACKGROUND

Field

Aspects of the present invention generally relate to power control of an image forming apparatus.

Description of the Related Art

In recent years, amid growing environmental awareness, attempts have been made to save power of image forming apparatuses such as copying machines. For example, when an apparatus is not used for a predetermined time, or when a user instructs a shift to a low power consumption state (i.e., sleep mode), the apparatus is shifted to the sleep mode to save the power. This sleep mode is provided to achieve power saving by stopping power supply to, for example, a printer unit and a scanner unit.

However, when using the apparatus shifted to the sleep mode, the user needs to press a button to return the apparatus from the sleep mode or needs to wait some time to use the apparatus after pressing the button, which is less convenient for the user. To address this situation, image forming apparatuses with sensors have appeared. This type of image forming apparatus includes a human body detection sensor such as an infrared sensor and a capacitance sensor, and returns from a sleep mode by detecting proximity of a user to the apparatus.

However, depending on the type or usage of the human body detection sensor, the human body detection sensor causes a return by erroneously detecting the user in some cases. For example, in a case where the apparatus is installed at a passage, a return from sleep occurs when the sensor detects a person merely passing by the apparatus, as a user. To prevent this situation, it is conceivable to reduce a detection range of the human body detection sensor, so that the apparatus returns from sleep only when a user stands extremely close to the apparatus. However, in this solution, the user may stand at a position falling outside the detection range or a return from sleep may take a longer time due to a delay in user detection, which is less convenient.

In this connection, one technique has been discussed as follows. This technique detects a human body with a human body detection sensor driven by time division. The presence of the human body is determined when a human body detection signal is continuously output from the human body detection sensor only during a predetermined time interval. When this determination is made, a return from a sleep mode occurs (see Japanese Patent Application Laid-Open No. 2002-71833). According to the technique in Japanese Patent Application Laid-Open No. 2002-71833, a human body is determined to be a user, when being in proximity to the human body detection sensor for more than a given time period. Therefore, it is possible to prevent an unintended return from a sleep mode, without reducing a detection range of the human body detection sensor.

However, in the above-described conventional technique, when a user approaches and then stops in front of an image forming apparatus to take a sheet output from this apparatus, the user is assumed to be a human body present in proximity to the sensor for a predetermined time. Therefore, a return from the sleep mode occurs. On the other hand, when a user who desires to immediately use the image forming apparatus approaches, the user needs to wait for the predetermined time, which is less convenient.

SUMMARY

Aspects of the present invention are generally directed to a mechanism capable of implementing both user convenience and power saving. This mechanism immediately returns an apparatus from a power saving state by detecting approach of a user, while reducing false returns from the power saving state that occur in response to a person passing by the apparatus and a person coming only to take a printed sheet.

According to an aspect of the present invention, an image forming apparatus that shifts between a first power state and a second power state in which power consumption is less than that in the first power state, includes a detecting unit configured to include a plurality of elements arranged on a line or in a grid to detect heat emitted from an object, and a determination unit configured to determine whether to perform a shift of a power state of the image forming apparatus from the second power state to the first power state by using a detection result of the detecting unit, and control the shift, wherein the determination unit changes a condition for shifting the power state of the image forming apparatus to the first power state, depending on from which element of the detecting unit a temperature equal to or higher than a predetermined temperature starts being detected.

Further features of the present disclosure will become apparent from the following description of exemplary embodiments with reference to the attached drawings.

BRIEF DESCRIPTION OF THE DRAWINGS

FIGS. 11A and 11B illustrate an example of a flowchart representing the algorithm B.

DESCRIPTION OF THE EMBODIMENTS

An exemplary embodiment will be described in detail with reference to the drawings, by way of example. Components in this exemplary embodiment are described merely as examples, and are not intended to be limiting.

Figure 1:
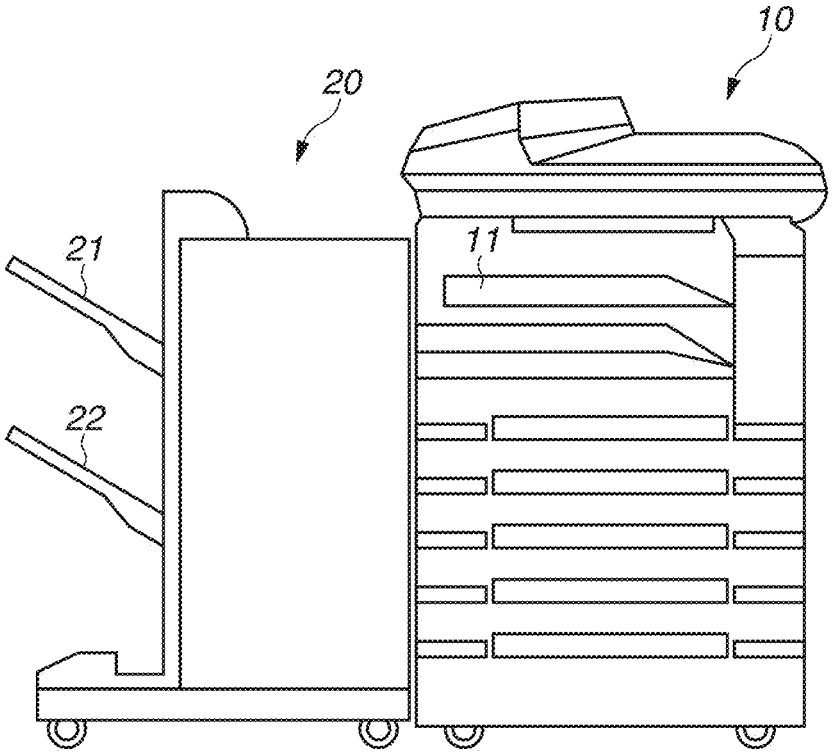
FIG. 1 is an external view of an image forming apparatus according to an exemplary embodiment.

FIG. 1 is a diagram illustrating an example of an appearance of an image forming apparatus 10 according to an exemplary embodiment.

The image forming apparatus 10 includes, for example, copy, scanner, fax, and printer functions. After execution of copying or printing, a finisher 20 discharges printed sheets to a tray 21 or a tray 22. In the present exemplary embodiment, sheets can be discharged to an intra-body sheet discharging unit 11 in a main body of the image forming apparatus 10. The finisher 20 is an optional device of the image forming apparatus 10. When the finisher 20 is not mounted on the image forming apparatus 10, printed sheets are output to the intra-body sheet discharging unit 11. Further, in the image forming apparatus 10, sheets can be discharged separately into the trays 21 and 22 of the finisher 20 and the intra-body sheet discharging unit 11, depending on the function such as the copy and fax functions.

Figure 2:
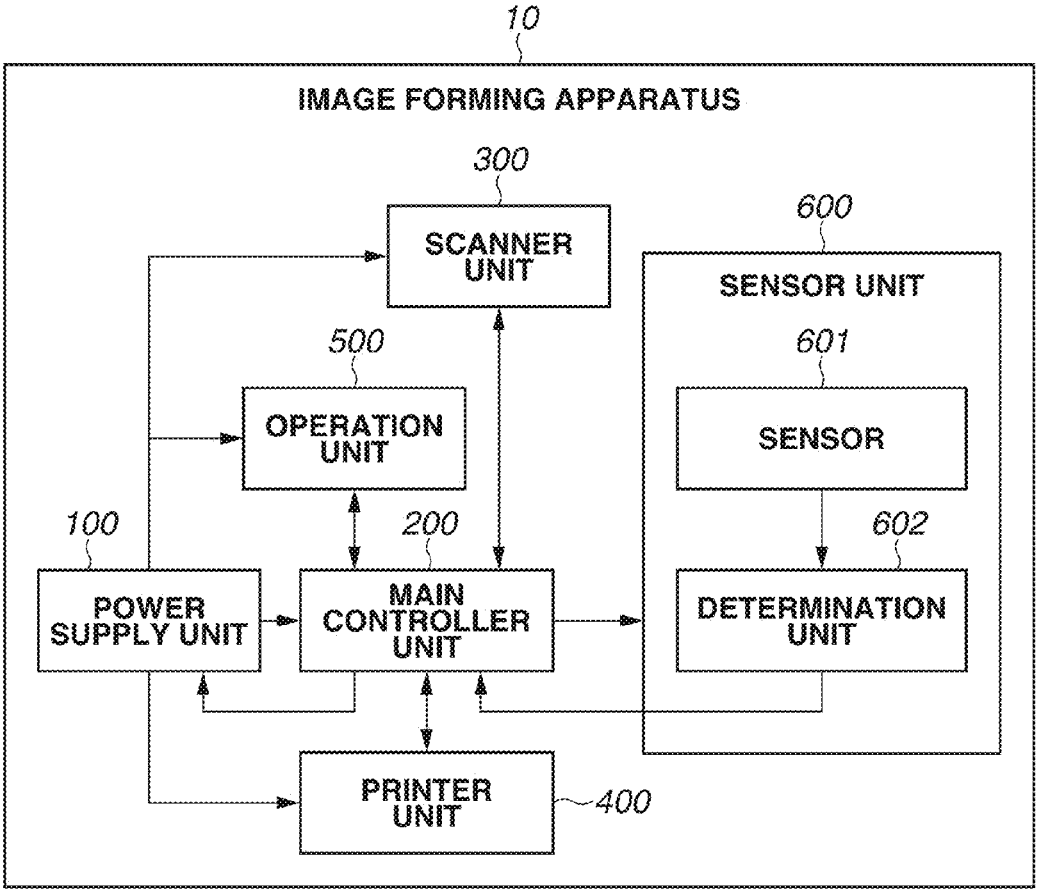
FIG. 2 is a block diagram illustrating an example of an overview configuration of the image forming apparatus.

FIG. 2 is a block diagram illustrating an overview configuration of the image forming apparatus 10, by way of example.

The image forming apparatus 10 includes a power supply unit 100, a main controller unit 200, a scanner unit 300, a printer unit 400, an operation unit 500, a sensor unit 600, as illustrated in FIG. 2. The main controller unit 200 includes components such as a central processing unit (CPU), a read only memory (ROM), and a random access memory (RAM) that are not illustrated. The main controller unit 200 controls the entire image forming apparatus 10, when the CPU reads a program stored in the ROM and executes the read program.

The image forming apparatus 10 has at least two power modes of a normal operation power mode in which operation such as copying is executed, and a sleep mode in which power consumption is less than in the normal operation power mode. When the image forming apparatus 10 is not used for more than a predetermined time, or when a user provides an instruction via the operation unit 500, the main controller unit 200 shifts the image forming apparatus 10 to the sleep mode by controlling the power supply unit 100. In the sleep mode, the power supply unit 100 is in a power saving state of stopping power supply to a part of each of the scanner unit 300, the printer unit 400, the main controller unit 200, and the operation unit 500.

The sensor unit 600 includes a sensor 601 and a determination unit 602. The power supply unit 100 supplies power to the sensor unit 600 via the main controller unit 200, even in the sleep mode. The power supply to the determination unit 602 may be stopped as appropriate in the sleep mode. However, in this case, the power supply to the determination unit 602 immediately starts upon detection of a predetermined reaction (e.g., upon detection of a temperature equal to or higher than a predetermined temperature) by the sensor 601. No power may be supplied to the sensor unit 600 in the normal operation power mode.

The determination unit 602 is, for example, a one-chip microcomputer. The determination unit 602 includes a processor, a ROM, and a RAM (not illustrated), and functions when the processor reads a program stored in the ROM and executes the read program. The determination unit 602 processes a detection result of the sensor 601 by executing an algorithm A or an algorithm B to be described below. Based on the result of this processing, the determination unit 602 determines whether to shift the image forming apparatus 10 from a sleep state to an ordinary power consumption state. The determination unit 602 then outputs an energization requesting signal (an instruction for a return from sleep) to the main controller unit 200, based on the result of the determination. Upon receiving the energization requesting signal, the main controller unit 200 returns the image forming apparatus 10 to the normal operation power mode by controlling the power supply unit 100. In other words, the image forming apparatus 10 is an apparatus capable of shifting to a power saving state. In particular, the image forming apparatus 10 is an apparatus in which power control is performed by detecting approach of a person through use of a sensor.

Figure 3:
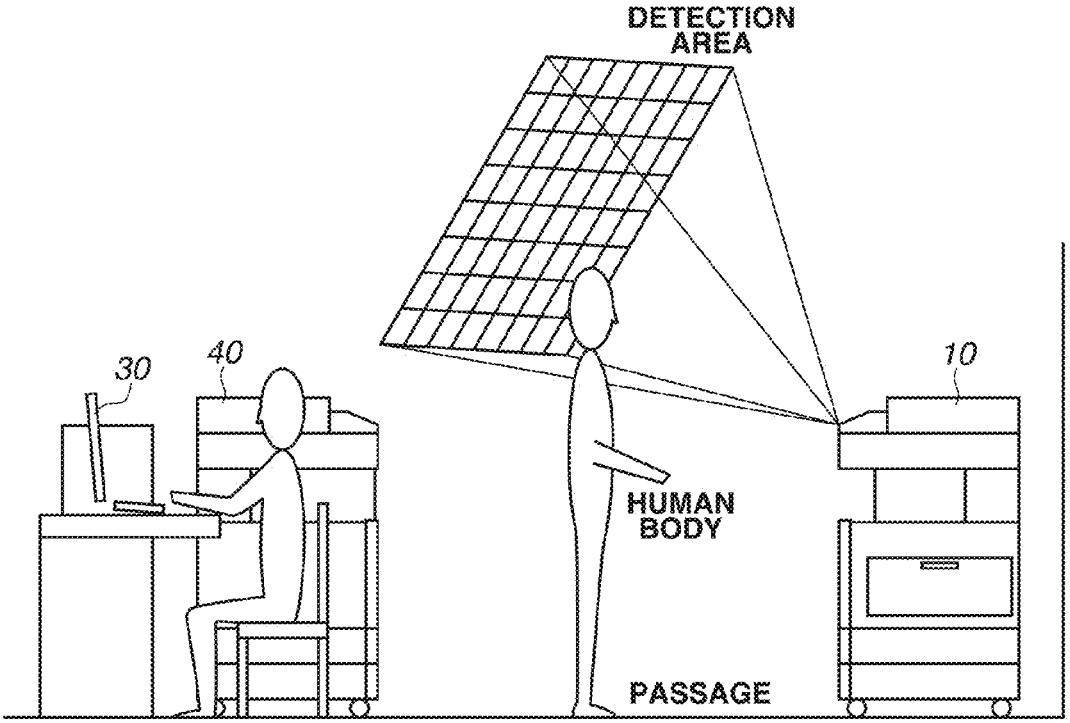
FIG. 3 is a diagram illustrating an example of a detection area of a sensor, by way of example.

FIG. 3 is a diagram illustrating an example of a detection area of the sensor 601.

The sensor 601 in FIG. 2 used in the image forming apparatus 10 is an infrared array sensor in which infrared sensors are arranged on M×N lines or arranged in a grid. "M" and "N" are natural numbers, and may be identical values. The infrared array sensor has the following feature. That is, each of infrared light receiving elements arranged in a grid receives infrared light emitted from a heat source. A temperature value is detected from the infrared light received by each of the light receiving elements, and using this temperature value, a shape of the heat source is detected as temperature distribution. Utilizing this feature, the determination unit 602 can detect the temperature distribution of an object approaching the image forming apparatus 10, and can determine that the object is a person based on the shape and temperatures resulting from this detection. In addition, the determination unit 602 can determine a detected position of a person in the detection area of the sensor 601, based on the above-described temperature distribution.

Detecting an exposed part of skin increases the accuracy of detecting the body temperature of a person. Therefore, in order to detect the body temperature of a person reliably, the image forming apparatus 10 is configured to be capable of detecting the temperature of the face of a person approaching the image forming apparatus 10, by setting the detection area of the sensor 601 to be obliquely upward from the front of the image forming apparatus 10. The image forming apparatus 10 can be configured not to detect heat of another apparatus 40 disposed in front of (front side) the image forming apparatus 10, a personal computer (PC) or a monitor 30 on a desk, or a person sitting on a chair, by orienting a detection plane of the sensor 601 obliquely upward from the front of the image forming apparatus 10.

The sensor 601 is also configured as follows. The sensor 601, which is an infrared array sensor, can output an interrupt signal when any of the M×N infrared light receiving elements exceeds a predetermined temperature. Therefore, the sensor 601 can detect which one of the light receiving elements has detected a temperature exceeding the predetermined temperature, by reading the value of a register in the sensor 601. In the image forming apparatus 10, the determination unit 602 remains energized to perform operation for reading the detection result of the sensor 601 at predetermined intervals. However, the above-described interrupt function of the sensor 601 may be used to start energizing the determination unit 602, so that power consumption of the determination unit 602 can be reduced.

Figures 4A, 4B, 4C:
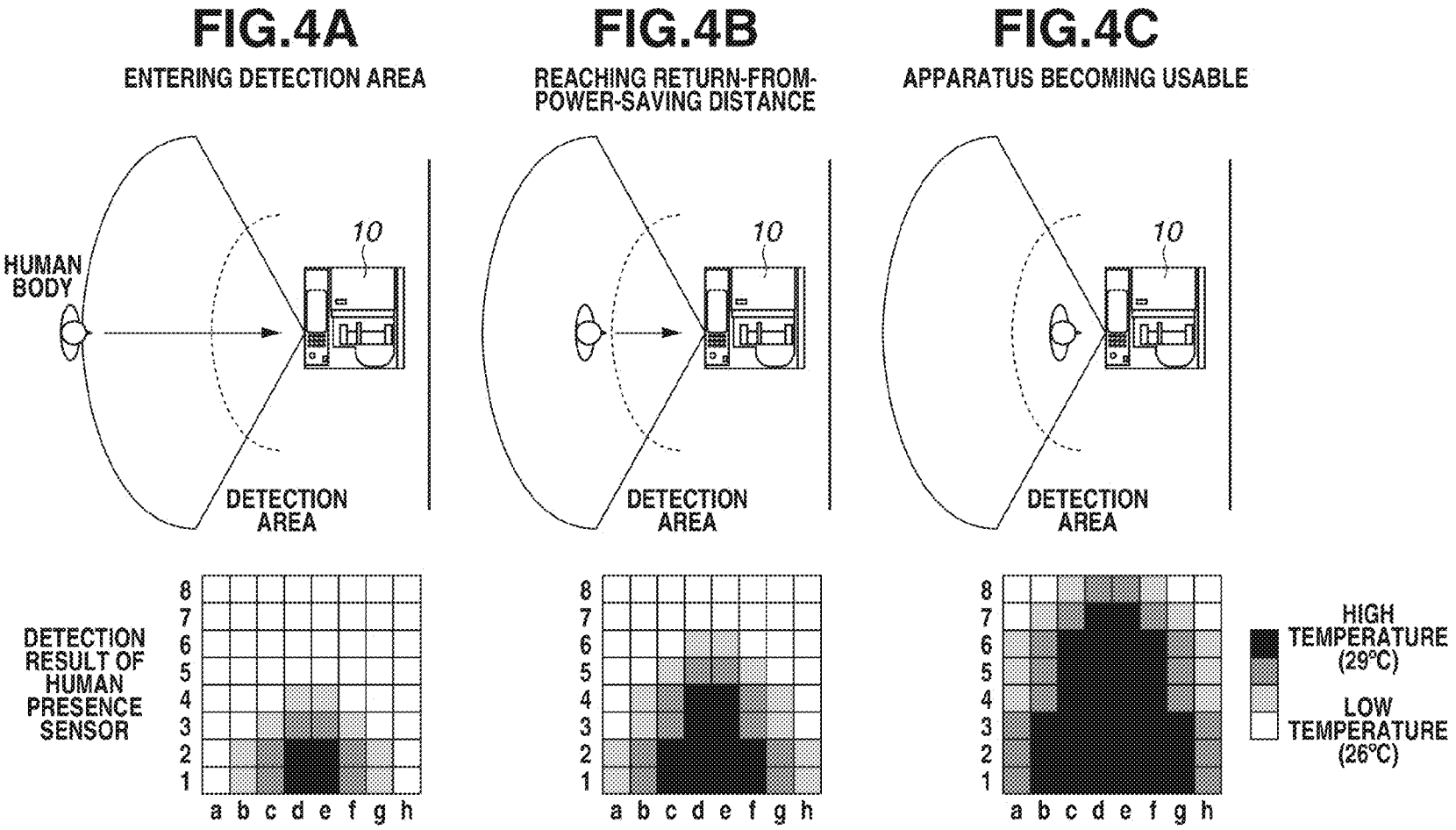
FIGS. 4A, 4B, and 4C are diagrams each illustrating an example of a position of a person approaching from the front and a detection result of the sensor.

FIGS. 4A, 4B, and 4C are diagrams each illustrating a position of a person, and a detection result of the sensor 601, when a person approaches the image forming apparatus 10 from the front (the front side direction of the image forming apparatus 10).

FIGS. 4A, 4B, and 4C each illustrate a distance between the image forming apparatus 10 and a human body in an upper part, and illustrate a detection result of the sensor 601 at this distance in a lower part. In the present exemplary embodiment, the infrared array sensor used for the sensor 601 includes the 8×8 infrared light receiving elements that are two-dimensionally arranged in eight rows "1" to "8" and eight columns "a" to "h". In other words, sixty-four infrared light receiving elements in total are arranged. In the following description, any of the elements 1*a* to 8*h* represents the position of each of the infrared light receiving elements in the infrared array sensor.

FIG. 4A illustrates a detection result of the sensor 601 when a human body is within a distance (detection area) in which the sensor 601 can detect the human body. According to this detection result of the sensor 601, a heat source is detected at some points by the elements in a lower part (on a lower side) of the sensor 601, such as the elements 1*d*, 1*e*, 2*d*, and 2*e*. When the human body approaches the image forming apparatus 10, the detection result of the sensor 601 spreads in such a manner that a temperature detection range expands to an area vertically extending from the first row to the fourth row and also laterally extending from the column "c" to the column "f", as illustrated in FIG. 4B. While the person moves from the position in FIG. 4A to the position in FIG. 4B, the determination unit 602 determines whether the person is in a state of approaching the image forming apparatus 10, based on the detection result of the sensor 601. Further, when the human body reaches a usable area of the image forming apparatus 10, temperatures are detected almost in the entire detection area (by most of the elements in the sensor 601) as illustrated in FIG. 4C.

Figure 5:
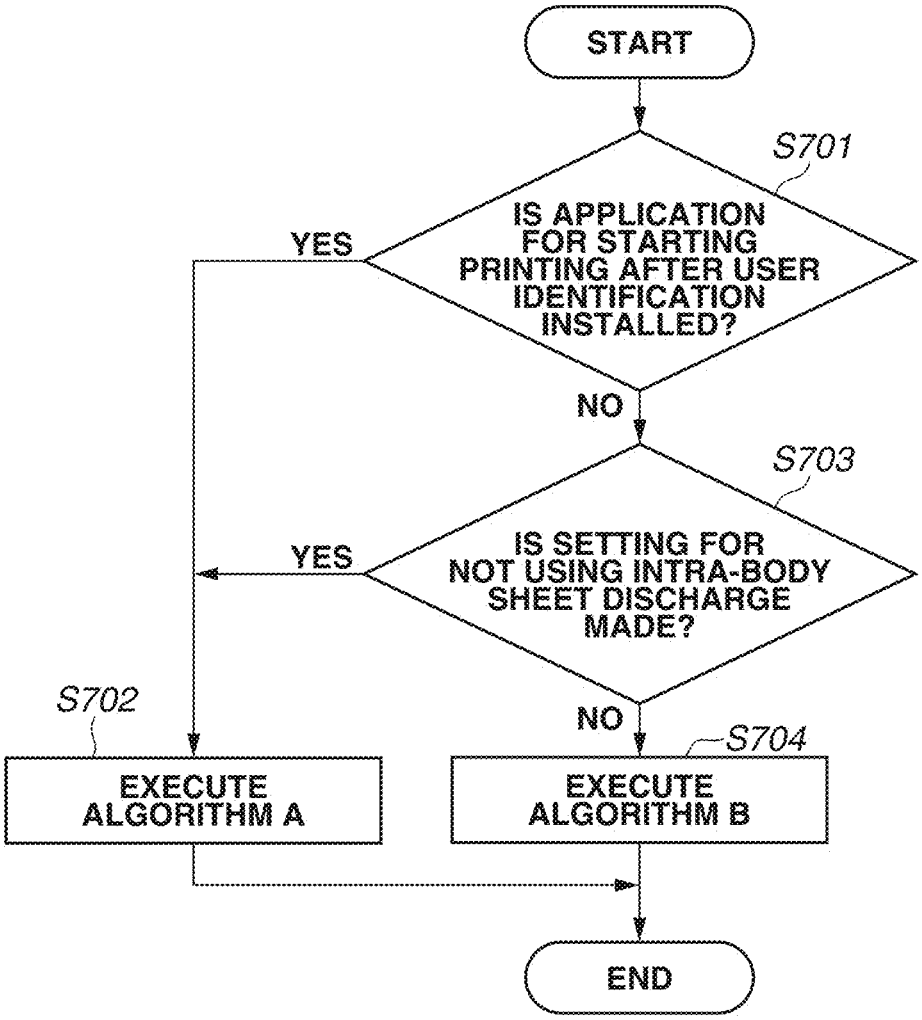
FIG. 5 is a flowchart illustrating an example of an operation for changing a human-body detection algorithm.

FIG. 5 is a flowchart illustrating an example of an operation for changing a human-body detection algorithm of the image forming apparatus 10. The CPU in the main controller unit 200 of the image forming apparatus 10 reads a program stored in the ROM and executes the read program, to implement this flowchart. The processing of this flowchart is executed, for example, upon activation of the main controller unit 200.

In step S701, the main controller unit 200 determines whether application software for starting printing after user identification is performed, is installed on the image forming apparatus 10. This application software prevents a printed sheet from being seen by others.

When the application software is installed, no user is likely to approach the image forming apparatus 10 only for taking a printed sheet. Therefore, if the main controller unit 200 determines that the application software is installed (Yes in step S701), then in step S702, the main controller unit 200 sets "algorithm A" as an algorithm to be executed by the determination unit 602. The "algorithm A" is used to immediately return the image forming apparatus 10 from the sleep state upon approach of a user, while preventing a false return from occurring in response to a passerby.

On the other hand, if the main controller unit 200 determines that the application software is not installed (No in step S701), the processing proceeds to step S703. In step S703, the main controller unit 200 determines whether a setting for not using the intra-body sheet discharging unit 11 is made. The setting for not using the intra-body sheet discharging unit 11 can be made, for example, by a user via the operation unit 500 or a network, when the finisher 20 is provided for the image forming apparatus 10. When the setting for not using the intra-body sheet discharging unit 11 is made, all the printed sheets are output to the finisher 20.

If the main controller unit 200 determines that the setting for not using the intra-body sheet discharging unit 11 is made (Yes in step S703), the processing proceeds to step S702. In this case, a user goes to the finisher 20 to take a printed sheet. Therefore, it is assumed that no user is likely to approach the image forming apparatus 10 only for taking a printed sheet. Accordingly, in step S702, the main controller unit 200 sets the above-described "algorithm A" as an algorithm to be executed by the determination unit 602.

On the other hand, when the setting for not using the intra-body sheet discharging unit 11 is not made, a user may come to take a printed sheet therefrom. In other words, there may be a user approaching the image forming apparatus 10 only for taking a printed sheet. Therefore, if the main controller unit 200 determines that the setting for not using the intra-body sheet discharging unit 11 is not made (No in step S703), then in step S704, the main controller unit 200 sets "algorithm B" as an algorithm to be executed by the determination unit 602. The "algorithm B" is used to prevent occurrence of a false return from the sleep mode when a user comes to take a printed sheet.

In the present exemplary embodiment, the processing of the above-described flowchart automatically sets an algorithm to be used by the determination unit 602 for human-body detection. However, a user may arbitrarily set an algorithm to be used by the determination unit 602 for human-body detection, via the operation unit 500 or a network.

In the above-described flowchart, it is determined whether the application software for starting printing after user identification is installed in the image forming apparatus 10 to prevent a printed sheet from being seen by others. When the application software is installed, "algorithm A" is set as an algorithm to be executed by the determination unit 602. However, the main controller unit 200 may determine whether a mode for starting printing after user identification is performed to prevent a printed sheet from being seen by others (hereinafter referred to as "pull-print mode") is set. In this case, "algorithm A" may be set as an algorithm to be executed by the determination unit 602, when the pull-print mode is set.

Further, the main controller unit 200 may also execute the processing in the flowchart of FIG. 5, when, for example, an application program is installed on the image forming apparatus 10, or an option configuration is changed.

The algorithm A to be executed by the determination unit 602 will be described below with reference to FIGS. 6A, 6B, 6C, 6D, 6E, and 6F to FIG. 9.

FIGS. 6A, 6B, 6C, 6D, 6E, and 6F are diagrams illustrating a high-speed return process of the algorithm A. The high-speed return process corresponds to a process for quickly returning the image forming apparatus 10 from the sleep state upon approach of a user. The processor in the determination unit 602 reads a program stored in the ROM and executes the read program, to implement this processing.

Figures 6A, 6B, 6C, 6D, 6E, 6F:
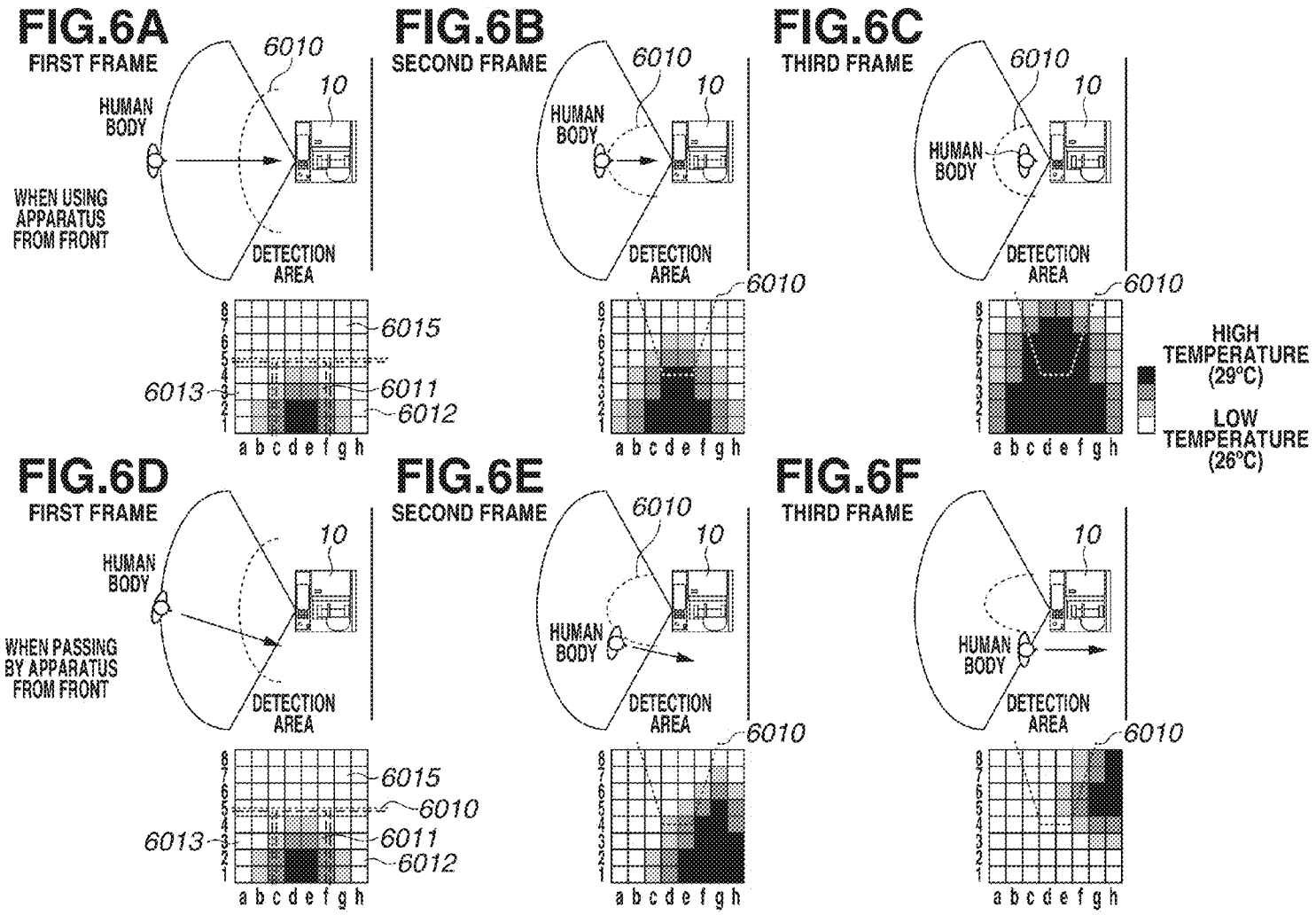
FIGS. 6A, 6B, 6C, 6D, 6E, and 6F are diagrams illustrating a high-speed return process of an algorithm A.

In FIGS. 6A, 6B, 6C, 6D, 6E, and 6F, FIGS. 6A to 6C illustrate a case where a person approaches from the front (front side direction of the image forming apparatus 10), and then uses the image forming apparatus 10. FIGS. 6D to 6F illustrate a case where a person approaches from the front and then passes by a side of the image forming apparatus 10.

FIGS. 6A and 6D each illustrate a detection result of the infrared array sensor when a human body is within the distance (detection area of the sensor 601) in which the sensor 601 can detect the human body. According to the detection result of the infrared array sensor, a heat source is detected at some points by the elements in the lower part of the sensor 601, such as the elements 1*d*, 1*e*, 2*d*, and 2*e*. Further, a threshold (hereinafter, referred to as "sensor threshold") 6010 is set beforehand in the fifth row within the detection area of the sensor 601. In the high-speed return process, a position where a person starts appearing in the detection area of the sensor 601 is determined first.

More specifically, as illustrated in FIG. 6A, an area A 6011, an area B 6012, and an area C 6013 are set beforehand in the detection area of the sensor 601, and it is determined in which area vertex coordinates of a lump of a heat source appear. In the example of FIGS. 6A, 6B, 6C, 6D, 6E, and 6F, a boundary between the area A 6011 and the area B 6012 is set on the column "f", and a boundary between the area A 6011 and the area C 6013 is set on the column "c". In the example of FIGS. 6A, 6B, 6C, 6D, 6E, and 6F, the areas A to C are each indicated as a rectangular area, however, it is not limited thereto. The vertex coordinates of the lump of the heat source are assumed to be, for example, an average of the coordinates of vertexes closest to the top of the sensor 601, of lumps of the heat source.

In the example of FIGS. 6A, 6B, 6C, 6D, 6E, and 6F, it is determined that a heat source is detected in the area A, when the heat source is detected by the elements 1*d*, 1*e*, 2*d*, and 2*e*, or the elements 1*c*, 1*d*, 2*c*, and 2*d*, or the elements 1*e*, 1*f*, 2*e*, and 2*f*. Further, it is determined that a heat source is detected in the area B, when the heat source is detected by the elements 1*f*, 1*g*, 2*f*, and 2*g*, or the elements 1*g*, 1*h*, 2*g*, and 2*h*. Furthermore, it is determined that a heat source is detected in the area C when the heat source is detected by the elements 1*a*, 1*b*, 2*a*, and 2*b*, or the elements 1*b*, 1*c*, 2*b*, and 2*c*.

When the vertex coordinates of a heat source indicating a person are present in the area A 6011, the sensor threshold 6010 is reset in the subsequent frames, as illustrated in FIGS. 6B, 6C, 6E, and 6F. When a person approaches from the front and then uses the image forming apparatus 10, the vertex coordinates of a heat source enter an area 6015 (an area surrounded by the sensor threshold 6010 and the upper end of the sensor 601) above the sensor threshold 6010 in FIGS. 7A, 7B, and 7C. Therefore, the number of elements indicating a heat source in the area indicated by the sensor threshold 6010 increases as the frame advances to the next frame. On the other hand, when a person approaches from the front and then passes by the image forming apparatus 10, there is no increase in the number of elements indicating a heat source in the sensor threshold 6010, because the vertex coordinates of the heat source are not in the area indicated by the sensor threshold 6010. Therefore, it is possible to determine whether a person approaching the image forming apparatus 10 (a heat source detected by the sensor 601) is a user or a passerby, by determining this difference (the presence or absence of an increase in the number of elements indicating the heat source in the area indicated by the sensor threshold 6010).

Figure 7A:
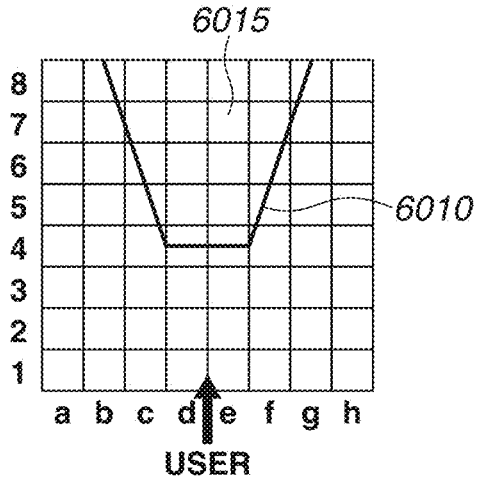
FIGS. 7A, 7B, and 7C are diagrams each illustrating an example of a reset sensor threshold.
Figure 7B:
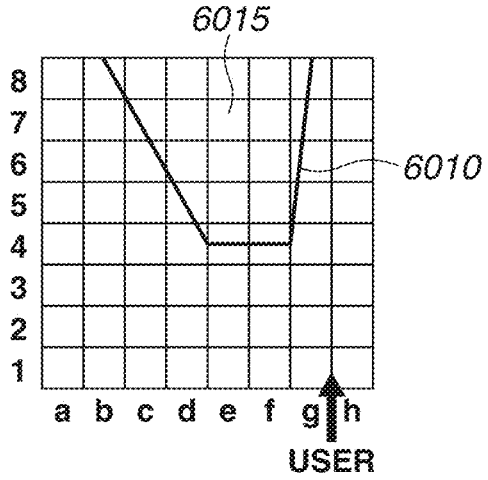
Figure 7C:
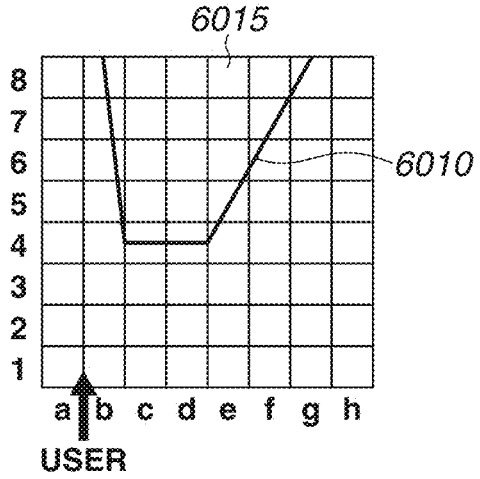

FIGS. 6A, 6B, 6C, 6D, 6E, and 6F illustrate only a case for the area A. However, the sensor threshold 6010 is reset to an appropriate sensor threshold in a case for each of the areas B and C as well. For example, a sensor threshold is set as illustrated in each of FIGS. 7A, 7B, and 7C. FIGS. 7A, 7B, and 7C are diagrams each illustrating an example of the sensor threshold 6010 reset according to a position where detection of a person starts.

FIG. 7A illustrates the sensor threshold 6010 reset when a position where detection of a person starts is in the area A (similar to FIGS. 6A, 6B, 6C, 6D, 6E, and 6F). FIG. 7B illustrates the sensor threshold 6010 reset when a position where detection of a person begins is in the area B. FIG. 7C illustrates the sensor threshold 6010 reset when a position where detection of a person starts is in the area C. When a position where detection of a person starts is in the area A (B, C), this situation corresponds to a case where detection of temperatures equal to or higher than a predetermined temperature starts from the elements in the area A (B, C).

In the present exemplary embodiment, the determination unit 602 resets the sensor threshold 6010 so that the sensor threshold 6010 is lowered toward the area where the detection of the heat source starts, as illustrated in FIGS. 7A, 7B, and 7C, for example. In other words, the sensor threshold 6010 is reset so that the area 6015 located above the sensor threshold 6010 takes a shape protruding toward the area where the detection of the heat source starts. Using the sensor threshold 6010 thus reset, the determination unit 602 can return the image forming apparatus 10 from the sleep state by efficiently detecting a user approaching the image forming apparatus 10. The areas as well as the numbers and shapes of the sensor threshold 6010 described here are mere examples, and may be programmably modifiable according to factors such as the position where a person starts appearing and the placement of a human presence sensor.

Figures 8A, 8B, 8C:
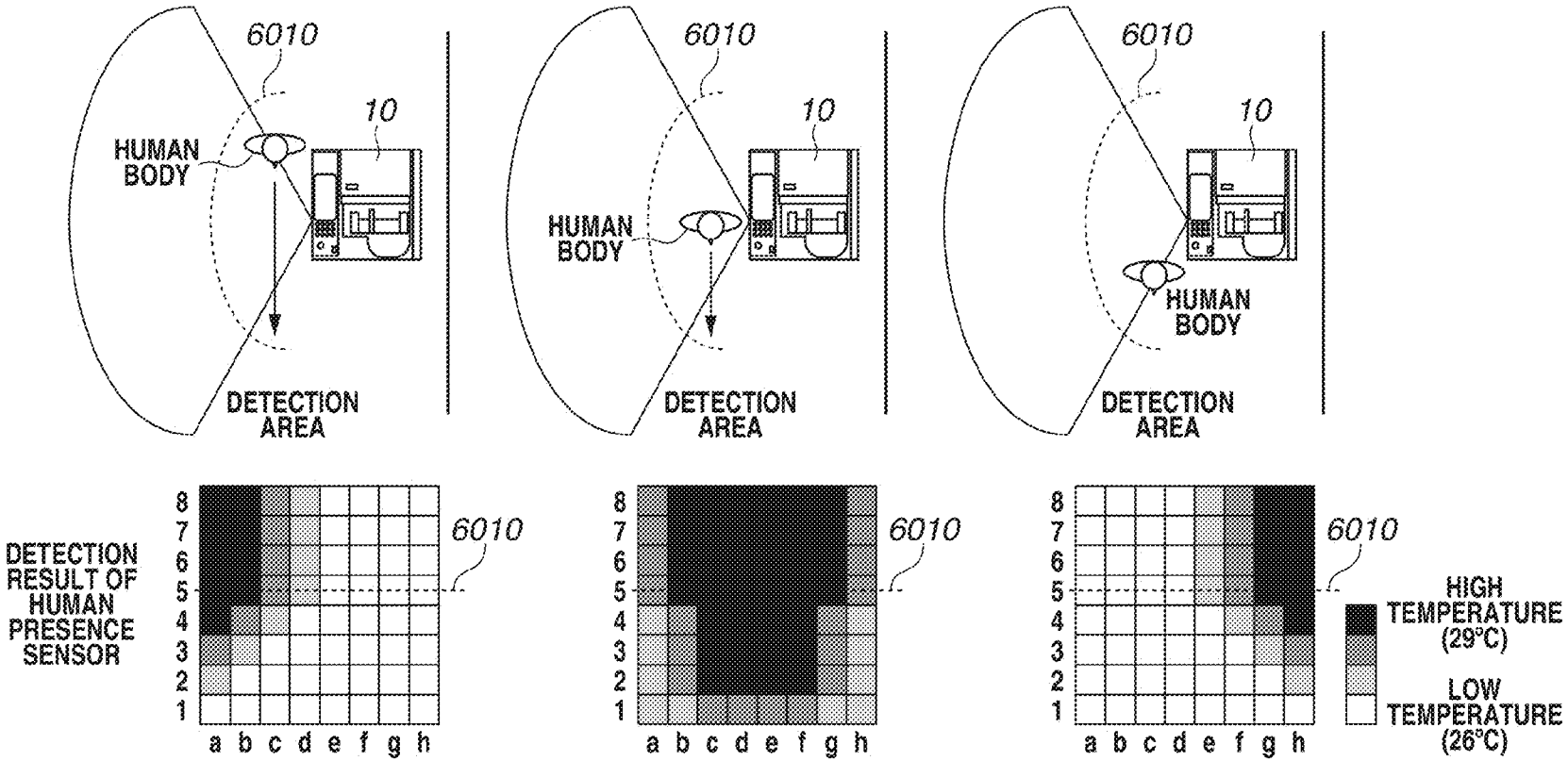
FIGS. 8A, 8B, and 8C are diagrams illustrating a normal return process of the algorithm A.

FIGS. 8A, 8B, and 8C are diagrams illustrating a normal return process of the algorithm A. The normal return process corresponds to a process for returning the image forming apparatus 10 to a normal power mode if a user waits over a given time period, while preventing a false return due to a passerby.

FIG. 8A illustrates a case where a person approaches the image forming apparatus 10 from a side (a side of the image forming apparatus 10). In this case, a heat source starts appearing in the area above the sensor threshold 6010 set at the fifth row in the detection area of the sensor 601. The heat source is also present in the area above the sensor threshold 6010 (i.e., an area covering the sixth and subsequent rows) when the person passes just in front of the image forming apparatus 10, as illustrated in FIGS. 8B and 8C.

In the case illustrated in FIGS. 8A, 8B, and 8C, the position where the person starts appearing is extremely close to the image forming apparatus 10, as compared with the case illustrated in FIGS. 6A, 6B, 6C, 6D, 6E, and 6F. For this reason, it is difficult to quickly determine whether the person is a user or a passerby, and therefore, a false return is highly likely to occur. Therefore, when a person starts appearing at a position close to the image forming apparatus 10, the image forming apparatus 10 is shifted to the normal power mode if it is determined that the person has waited over a given time period in front of the image forming apparatus 10. As compared with the high-speed return process described above, the normal return process requires a time before a return occurs. However, there is such an advantage that approach of a user from every direction can be handled (a false return is less likely to occur).

As described above, in the algorithm A, when detection of temperatures equal to or higher than the predetermined temperature starts from the elements within the area (set area) above the sensor threshold 6010, the determination unit 602 instructs a return from sleep, on condition that these elements within the set area keep detecting the temperatures equal to or higher than the predetermined temperature for a predetermined time or longer, as illustrated in FIGS. 8A, 8B, and 8C. On the other hand, when detection of temperatures equal to or higher than the predetermined temperature starts from the elements outside the set area, the determination unit 602 instructs a return from sleep, on condition that the elements within the set area detect temperatures equal to or higher than the predetermined temperature, as illustrated in FIGS. 6A, 6B, 6C, 6D, 6E, and 6F.

Figure 9:
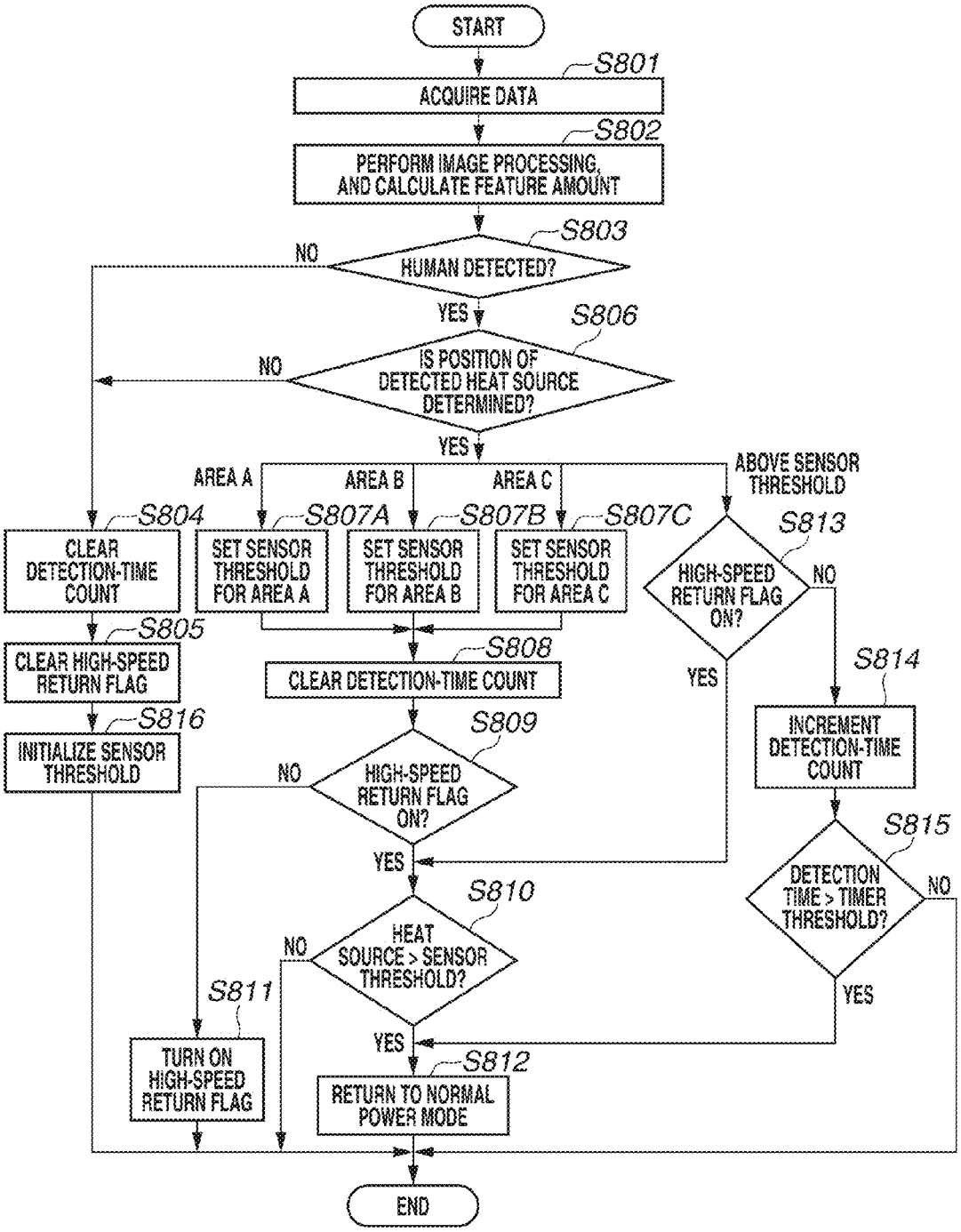
FIG. 9 is a flowchart illustrating the algorithm A by way of example.

FIG. 9 is a flowchart illustrating an example of the algorithm A. The algorithm illustrated in this flowchart has two functions, i.e., the high-speed return process of the algorithm A illustrated in FIGS. 6A, 6B, 6C, 6D, 6E, and 6F, and the normal return process of the algorithm A illustrated in FIGS. 8A, 8B, and 8C. This algorithm A is executed each time the determination unit 602 acquires new data from the sensor 601 (for each frame). However, this execution timing is not necessarily limited thereto. For example, the processing may be performed for one in every ten frames, and the determination unit 602 may be shifted to a power saving state for the remaining nine frames, so that power consumption can be reduced. The determination unit 602 including the components such as the processor reads a program stored in the ROM (not illustrated), and executes the read program, to implement this flowchart.

In step S801, the determination unit 602 acquires a sensor output result from the sensor 601. Next, in step S802, the determination unit 602 removes false detection factors such as noise and other heat sources by performing processes such as filtering, binarization, labeling, and feature amount calculation on the data acquired in step S801. The determination unit 602 then modifies and extracts data so that appropriate determination can be performed.

Next, in step S803, the determination unit 602 determines whether a person is within the detection area of the sensor unit 600, based on the data processed in step S802. More specifically, when there are four lumps of a heat source indicating temperatures (e.g., 29 degrees or higher) equal to or higher than the predetermined temperature as illustrated in FIG. 4A, the determination unit 602 regards the heat source as a person and determines that the person is within the detection area. In other words, when there are four or more elements detecting temperatures equal to or higher than the predetermined temperature, the heat source is regarded as a person. On the other hand, when no heat source is present in the detection area or when lumps of a heat source are fewer than four lumps, the determination unit 602 determines that no person is present in the detection area. In the present exemplary embodiment, when there are four lumps of a heat source indicating temperatures equal to or higher than the predetermined temperature, the heat source is determined to be a person. However, the number of lumps is not necessarily four, and may be smaller than four, or five or more, or programmably modifiable.

In step S803, if the determination unit 602 determines that no person is within the detection area (No in step S803), the processing proceeds to steps S804, S805, and S816, to clear static variables in the respective steps. This ends the processing at the current frame. More specifically, in step S804, the determination unit 602 clears the value of a detection-time count stored in the RAM provided in the determination unit 602. Subsequently, in step S805, the determination unit 602 clears the value of a high-speed return flag stored in the RAM. Further, in step S816, the determination unit 602 initializes the sensor threshold to the sensor threshold 6010 illustrated in FIGS. 6A and 6D.

On the other hand, in step S803, when the determination unit 602 determines that a person is within the detection area (Yes in step S803), the processing proceeds to step S806. In step S806, the determination unit 602 determines in which area a position represented by the vertex coordinates of a heat source is present.

Here, when the determination unit 602 determines that the vertex coordinates of the heat source is present in the area A 6011 illustrated in FIG. 6A (when a result is "area A" in step S806), the processing proceeds to step S807A to set the sensor threshold 6010 for the area A as illustrated in FIG. 7A. The processing then proceeds to step S808. Alternatively, when the determination unit 602 determines that the vertex coordinates of the heat source is present in the area B 6012 illustrated in FIG. 6A (when a result is "area B" in step S806), the processing proceeds to step S807B to set the sensor threshold 6010 for the area B as illustrated in FIG. 7B. The processing then proceeds to step S808. Still alternatively, when the determination unit 602 determines that the vertex coordinates of the heat source is present in the area C 6013 illustrated in FIG. 6A (when a result is "area C"), the processing proceeds to step S807C to set the sensor threshold 6010 for the area C as illustrated in FIG. 7C. The processing then proceeds to step S808.

In step S808, the determination unit 602 clears the detection-time count, and the processing proceeds to step S809. In step S809, the determination unit 602 determines whether the high-speed return flag is ON. If the determination unit 602 determines that the high-speed return flag is not ON (i.e., OFF) (No in step S809), then, in step S811, the determination unit 602 turns on the high-speed return flag. Then, the processing of this flowchart ends.

On the other hand, in step S809, when the determination unit 602 determines that the high-speed return flag is ON (Yes in step S809), the processing proceeds to step S810. In step S810, the determination unit 602 determines whether the vertex coordinates of the heat source are beyond the sensor threshold 6010. The case where the vertex coordinates of the heat source are beyond the sensor threshold 6010 indicates a case where temperatures equal to or higher than the predetermined temperature are detected by the elements in the area 6015 above the sensor threshold 6010.

When the determination unit 602 determines that the vertex coordinates of the heat source are not beyond the sensor threshold 6010 (No in step S810), the processing of this flowchart ends. On the other hand, when the determination unit 602 determines that the vertex coordinates of the heat source are beyond the sensor threshold 6010 (the person is detected in the area within the sensor threshold 6010) (Yes in step S810), the determination unit 602 determines that the person is in a state of approaching the image forming apparatus 10 from the front. Subsequently, in step S812, the determination unit 602 returns the image forming apparatus 10 to the normal power mode, and the processing of this flowchart ends.

In step S806, when the determination unit 602 determines that the vertex coordinates of the heat source are present above the sensor threshold 6010 (when a result is "above sensor threshold" in step S806), the processing proceeds to step S813. When the position at which the vertex coordinates of the heat source start appearing is above the sensor threshold 6010, this situation indicates the case illustrated in FIGS. 8A, 8B, and 8C. More specifically, the result corresponds to the case where the elements first detecting temperatures equal to or higher than the predetermined temperature in the sensor 601 are the elements (the elements 6*a* to 8*h*) in the area above the sensor threshold 6010.

In step S813, the determination unit 602 determines whether the high-speed return flag is ON. When the high-speed return flag is ON, the person approaching the image forming apparatus 10 is within the area A, the area B, or the area C for the high-speed return at the previous frame and thus, the high-speed return process is performed at the current frame. Therefore, if the determination unit 602 determines that the high-speed return flag is ON (Yes in step S813), then in step S812, the determination unit 602 returns the image forming apparatus 10 to the normal power mode. Then, the processing of this flowchart ends.

On the other hand, when the high-speed return flag is OFF, c determines that the person has started to appear at a position close to the side of the image forming apparatus 10 as illustrated in FIGS. 8A, 8B, and 8C, and performs the normal return process. Therefore, when the determination unit 602 determines that the high-speed return flag is not ON in step S813 (No in step S813), the processing proceeds to step S814 to increment the detection-time count of the heat source. Further, in step S815, the determination unit 602 determines whether the detection time is beyond a timer threshold set beforehand. When the determination unit 602 determines that the detection time is not beyond the timer threshold (No in step S815), the determination unit 602 determines that the person has not stayed in front of the image forming apparatus 10 for a given time period. Then, the processing of this flowchart ends.

On the other hand, in step S815, when the determination unit 602 determines that the detection time is beyond the timer threshold (Yes in step S815), the processing proceeds to step S812. In step S812, the determination unit 602 determines that the person has stayed in front of the image forming apparatus 10 for the given time period (for a predetermined time or longer), and returns the image forming apparatus 10 to the normal power mode. Then, the processing of this flowchart ends.

In a case where there is an area belonging to both the area A, B, or C and the area above the sensor threshold 6010 by resetting the sensor threshold 6010, and the heat source is located in the this area, the determination unit 602 determines that, for example, the position of the heat source is in the area A, B, or C, in step S806. Alternatively, in a case where there is an area belonging to none of the set areas and the heat source is located in this area (No in step S806), the processing of this flowchart ends directly from step S806.

The above-described step S807A, 807B, or 807C for resetting the sensor threshold 6010 may be executed only when the high-speed return flag is OFF and the detection time is zero, and if not, the processing may proceed to step S808 by skipping steps S807A, 807B, or 807C. In other words, the sensor threshold 6010 for the area A, B, or C may be set only when detection of a person starts in the area A, B, or C, while not being reset during the detection of the person by the sensor 601, even if the person moves to other areas.

As described above, using the algorithm A, the high-speed return process is applied to a user appearing at a position away from the image forming apparatus 10 (from the direction toward the front), and the normal return process is applied to a user appearing at a position close to (from a side of) the image forming apparatus 10. The high-speed return process and the normal return process described in the present exemplary embodiment are mere examples. The determination can be made using a factor such as an increase/decrease in dimension of a heat source and the shape of a heat source, without using the vertex coordinates of the heat source described here.

The algorithm B to be executed by the determination unit 602 will be described below with reference to FIGS. 10A, 10B, and 10C, as well as FIGS. 11A and 11B.

Figures 10A, 10B, 10C:
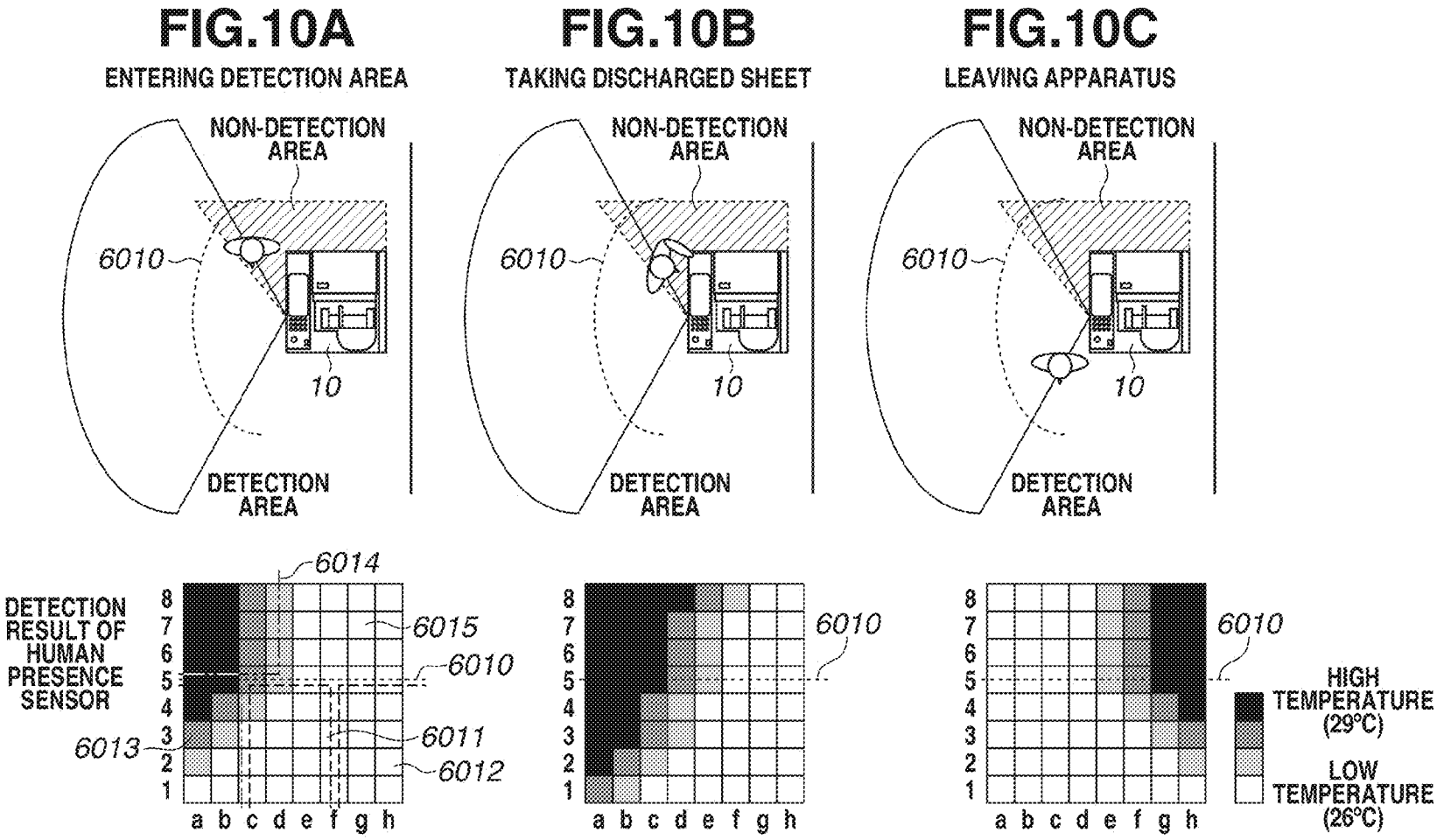
FIGS. 10A, 10B, and 10C are diagrams illustrating a non-detection process of an algorithm B.

FIGS. 10A, 10B, and 10C are diagrams illustrating a non-detection process of the algorithm B. The non-detection process corresponds to a process for preventing a false return of the image forming apparatus 10 from the sleep mode when a user comes to take a printed sheet.

FIG. 10A illustrates a state where a person comes to take a sheet output to the intra-body sheet discharging unit 11 in the image forming apparatus 10. Further, FIG. 10B illustrates a state where the person takes a sheet from the intra-body sheet discharging unit 11 while standing in front of the image forming apparatus 10. Furthermore, FIG. 10C illustrates a state where the person leaves the image forming apparatus 10.

In the state of FIG. 10B, the person stays in front of the image forming apparatus 10 for a certain time period, and therefore, a false return is highly likely to occur if the algorithm A is applied. On the other hand, to address this issue, the algorithm B sets a non-detection area, and prevents a return from occurring in response to a person entering from the non-detection area.

More specifically, the determination unit 602 determines whether there is a person beginning to appear in a non-detection area 6014 (e.g., 6*a* to 8*c*) set beforehand in the detection area of the sensor 601. When a person starts appearing in the non-detection area 6014, the determination unit 602 determines that the person approaches the image forming apparatus 10 from the non-detection area, and stops subsequent determination for a return from sleep. However, the determination as to whether there is a person in front of the image forming apparatus 10 continues, so that the image forming apparatus 10 returns to the normal operation when the person leaves the detection area of the sensor 601.

The sensor 601 may be installed on a side provided with the intra-body sheet discharging unit 11 of the image forming apparatus 10, and may be oriented in a central direction of the image forming apparatus 10.

FIGS. 11A and 11B are a flowchart illustrating an example of the algorithm B. The algorithm B illustrated in this flowchart has three functions, i.e., the high-speed return process illustrated in FIGS. 6A, 6B, 6C, 6D, 6E, and 6F, the normal return process illustrated in FIGS. 8A, 8B, and 8C, and the non-detection process illustrated in FIGS. 10A, 10B, and 10C. The determination unit 602 including the components such as a processor reads a program stored in the ROM (not illustrated), and executes the read program, to implement this flowchart.

FIG. 11A illustrates the normal operation (flow A) of the determination unit 602, and FIG. 11B illustrates the operation (flow B) when a person approaches the image forming apparatus 10 from the non-detection area. The high-speed return process and the normal return process included in the flow A of FIG. 11A are similar to those in FIG. 9 and therefore, the same steps are provided with the same step numbers and will not be described. Only steps different from the steps in FIG. 9 will be described below.

In step S806 of FIG. 11A, when the determination unit 602 determines that the vertex coordinates of the heat source are present in the non-detection area 6014 (when a result is "non-detection area" in step S806), the processing proceeds to step S817. When there is an area belonging to both the non-detection area 6014 and the area above the sensor threshold 6010, and the heat source is located in this area, the determination unit 602 determines that the position of the heat source is in the non-detection area 6014.

In step S817, the determination unit 602 determines whether the high-speed return flag is not ON (the high-speed return flag is OFF) and the detection time is "0". When the high-speed return flag is ON or the detection time is not "0", it can be determined that the heat source has entered the detection area of the sensor 601 from an area other than the non-detection area. Therefore, when the determination unit 602 determines that the high-speed return flag is ON or the detection time is not "0" (No in step S817), the processing proceeds to step S813.

On the other hand, when the high-speed return flag is OFF and the detection time is "0", it can be determined that the heat source has entered the detection area of the sensor 601 from the non-detection area. Therefore, when the high-speed return flag is OFF and the detection time is "0" (Yes in step S817), the determination unit 602 performs control to execute the flow B, starting from the next frame.

In the flow B, the determination unit 602 performs processing in a manner similar to steps S801 to S803. Specifically, the determination unit 602 acquires data in step S818, performs image processing as well as calculating a feature amount in step S819, and determines whether the person is detected in step S820, without performing other processing. When the determination unit 602 determines that the person is present in the detection area in step S820 (Yes in step S820), the determination unit 602 ends the processing at this frame, and performs control to execute the flow B successively on the next frame.

On the other hand, in step S820, when the determination unit 602 determines that the person is not present in the detection area (No in step S820), the determination unit 602 determines that the person is away from the sensor detection area. The determination unit 602 then performs control to execute the flow A again, starting from the next frame.

As described above, in the algorithm B, the determination unit 602 has a function (return restriction function) of aborting the determination of a return until the sensor 601 detects no person (i.e., a function of not issuing a return instruction either), when the sensor 601 detects a person in the non-detection area. The non-detection area is provided on a side where the sheet discharging unit 11 in the main body of the image forming apparatus 10 is disposed. The algorithm A corresponds to the algorithm B in which the above-described return restriction function is disabled. The main controller unit 200 performs control to disable the return restriction function, by setting the algorithm A as an algorithm to be executed by the determination unit 602. This control is performed when the setting for starting printing after user identification is made, or when the setting for not outputting sheets to the sheet discharging unit 11 in the main body of the image forming apparatus 10 is made. On the other hand, the main controller unit 200 performs control to enable the return restriction function, by setting the algorithm B as an algorithm to be executed by the determination unit 602. This control is performed when the setting for starting printing after user identification is not made and when the setting for not outputting sheets to the sheet discharging unit 11 in the main body of the image forming apparatus 10 is not made.

As described above, according to the present exemplary embodiment, the control is performed according to the position where a person starts appearing in the detection area of the sensor 601. More specifically, a return from sleep immediately occurs for a person approaching from a place away from the image forming apparatus 10 (from the front), and a false return is prevented for a person passing by the image forming apparatus 10 or a person coming only for taking a sheet. In addition, switching between the algorithms for these respective situations (i.e., switching between enabling and disabling of the return restriction function) can be automatically determined based on the status of the image forming apparatus 10, which can improve user convenience.

The present exemplary embodiment is described using the infrared array sensor as the sensor 601, but is not limited to this example. The present exemplary embodiment can be adapted to other cases, not to mention use of other types of sensor, and use of a device recognizing a human body such as a camera, so that similar processing is achieved. For example, when a camera is used, the determination unit 602 recognizes an image captured by the camera for every predetermined frame, and changes a condition for a return from sleep according to a position where an image of a person starts appearing (i.e., a position in the captured image).

For example, when an image of a person starts appearing from the area A, B, or C, the determination unit 602 resets the sensor threshold 6010 as illustrated in FIG. 7A, 7B, or 7C, and instructs a return from sleep on condition that the image of the person appears in the area 6015 above the sensor threshold 6010. Further, when an image of a person starts appearing from the area 6015 above the sensor threshold 6010, the determination unit 602 instructs a return from sleep on condition that the image of the person is present in the area 6015 for a predetermined time or longer. Furthermore, when an image of a person starts appearing from the non-detection area 6014, the determination unit 602 aborts the determination for a return from sleep until the image of the person disappears from a captured image (or may delay a return from sleep by a given time period or longer).

Exemplary embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™) a flash memory device, a memory card, and the like.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-051810 filed Mar. 14, 2014, which is hereby incorporated by reference herein in its entirety.

What is claimed is:

1. An image forming apparatus comprising:

a sensor unit for detecting a human;

a power supply unit which supplies power to a device of the image forming apparatus in a case where a detection result of the sensor unit satisfies a predetermined condition when power supply to the device is stopped; and a controller which specifies a position at which the human is first detected in a detection area of the sensor unit and changes the predetermined condition based on the specified position.

2. The image forming apparatus according to claim 1, wherein the sensor unit is disposed to face obliquely upward.

3. The image forming apparatus according to claim 1, wherein in a case where the specified position is in a first area on the far side from the image forming apparatus, the controller changes the predetermined condition to a condition that a human is detected in a second area on the near side from the image forming apparatus.

4. A control method for an image forming apparatus that shifts between a first power state and a second power state where power consumption is less than that in the first power state, the control method comprising:

detecting a human using a sensor unit;

shifting a power state of the image forming apparatus from the second power state to the first power state in a case where a detection result of the sensor unit satisfies a condition for shifting the power state of the image forming apparatus from the second power state to the first power state;

specifying a position at which the human is first detected in a detection area of the sensor unit; and changing the condition based on the position, specified by the specifying, at which the human is first detected.

5. A computer readable storage medium storing computer executable instructions for causing a computer to implement a control method for an image forming apparatus that shifts between a first power state and a second power state where power consumption is less than that in the first power state, the control method comprising:

detecting a human using a sensor unit;

shifting a power state of the image forming apparatus from the second power state to the first power state in a case where a detection result of the sensor unit satisfies a condition for shifting the power state of the image forming apparatus from the second power state to the first power state; and specifying a position at which the human is first detected in a detection area of the sensor unit; and changing the condition based on the position, specified by the specifying, at which the human is first detected.

6. The image forming apparatus according to claim 3, wherein, in a case where the specified position is in the second area on the near side from the image forming apparatus, the controller changes the predetermined condition to a condition that a state in which the human is being detected maintains for a predetermined time period.

7. The image forming apparatus according to claim 3, wherein, in a case where the specified position is in the first area on the far side from the image forming apparatus, the changing unit changes a shape of the second area based on the position, in the first area, at which the human is first detected.

8. The image forming apparatus according to claim 7, wherein the changing unit changes the shape of the second area to a shape pointing to the position, in the first area, at which the human is detected.

9. The image forming apparatus according to claim 1, wherein the sensor unit is an infrared sensor.

10. The image forming apparatus according to claim 1, wherein the sensor unit is an infrared array sensor.

11. The image forming apparatus according to claim 10, wherein the controller characterizes a feature point of a heat source that is detected by the sensor unit as a position at which a human is first detected.

12. The image forming apparatus according to claim 1, wherein the device is an operation unit which receives a user's operation.

13. The image forming apparatus according to claim 1, wherein the device is a printer unit which print an image on a sheet.

* * * * *